United States Patent [19]

Reimann

[11] Patent Number: 4,604,927

[45] Date of Patent: Aug. 12, 1986

[54] RAZOR BLADE CUTTER ASSEMBLY

[75] Inventor: George J. Reimann, Pittsford, N.Y.

[73] Assignee: Mobil Oil Corporation, New York, N.Y.

[21] Appl. No.: 658,727

[22] Filed: Oct. 9, 1984

[51] Int. Cl.[4] ..... B26F 1/44

[52] U.S. Cl. ..... 83/55; 83/658; 83/685; 83/697; 83/698

[58] Field of Search ..... 83/55, 658, 690, 685, 83/684, 697, 652, 653, 698

[56] References Cited

U.S. PATENT DOCUMENTS

| | | | |
|---|---|---|---|
| 1,453,200 | 4/1923 | Stacho | 83/697 X |
| 2,412,066 | 12/1946 | Shear | 83/685 X |
| 3,048,069 | 8/1962 | Berlin et al. | 83/685 X |
| 3,256,764 | 6/1966 | Hardy | 83/690 |
| 3,320,843 | 5/1967 | Schott, Jr. | 83/685 X |
| 3,587,382 | 6/1971 | Boyd | 83/652 X |

*Primary Examiner*—Frank T. Yost

*Attorney, Agent, or Firm*—Alexander J. McKillop; Michael G. Gilman; Charles J. Speciale

[57] ABSTRACT

In the art of cutting dies for layers of deformable stock material such as plastic, the improved cutting means combination and method which includes a razor blade cutting edge mounted on a punch press opposite a supporting cutting surface having a slot matching the shape of the razor blade cutting edge. The cutting edge is applied with appropriate pressure to the stack of material in the area of relief provided by the slot so that a clean efficient cut is effected through the stack of material. Preferably the razor blade cutting edge is a single blade so that problems such as material hang ups caused by incomplete cutting are minimized and/or completely eliminated.

17 Claims, 3 Drawing Figures

RAZOR BLADE CUTTER ASSEMBLY

BACKGROUND OF THE INVENTION

The present invention relates to the art of cutting dies and, in particular, to an improved combination cutter assembly and method useful for cutting a stack of stock material.

It is known in the art of high speed manufacturing of stock material to employ a die cutter to stamp or punch shapes, especially irregular shapes, in stacks of layered stock material such as paperboard and cardboard for cartons and rigid or semi-rigid structures. Certain problems are encountered in high speed systems, however, relating directly to the cutting element alone, which is usually a steel rule cutting die, or in combination with the cutting surface such as a soft urethane material fixed to a steel back up plate.

For instance, a cutting die such as a steel rule die must be maintained in careful alignment so that the cutting edge is more or less perfectly parallel to the cutting surface to insure a complete cut through all layers of the stock material over the entire length of the cutting edge. Furthermore, since steel rule cutting dies can be expected to have a width of about 1/16" the cut is relatively thick and the cutting surface quickly becomes worn. Consequently, the cutting surface is often mounted on a wheel which revolves after one or several cuts, depending on the toughness of the cutting surface, to change the location of the striking cutting blade so that the surface and the back up material does not wear out.

The problems listed above are exacerbated and other problems are encountered when the stock material is extremely thin and deformable such as in the case of plastic sheet material. For example, when a stack of thin stock material having resiliency is subjected to the cutting pressure of a thick cutting blade the individual layers of material can easily be fused together thus inhibiting the ability to separate the layers. Furthermore, thin deformable layers at the bottom of the cutting stroke readily wrap, and stretch in the case of plastic sheet material, around the end of the cutting blade rather separate as a severence.

It is, therefore, an object of the present invention to provide an improved combination cutting assembly for stamping or punching a die cut in a layered stack of stock material.

It is a further object to provide a cutting assembly capable of efficiently and cleanly cutting a layered stack of thin, deformable and resilient stock material such as plastic sheet material.

It is yet a further object of the present invention to provide a die cutting means for high speed production of stock material which does not incur repeated problems such as hang up and fused sheet material.

Other objects and advantages over the state of the art are provided by the present invention as it is disclosed herein, which will become apparent to those skilled in the art, forth herein.

SUMMARY OF THE INVENTION

The present invention is related to the art of cutting dies for stock material, and, in particular, very thin stock material which is deformable and which has resiliency. Specifically, the present invention is an improved combination cutting means and method which includes razor blade cutting edge mounted in the desired cutting shape on a punch pressing means directly opposite a cutting slot formed in a cutting surface such as a punch plate. The cutting slot extends in the shape of the cutting edge along the entire length thereof so that the razor blade cutting edge cuts completely through the layered stock material when the punch pressing means is pressed towards the punch plate. While the present invention is effective with any type of standard stock material such as paperboard and cardboard, it is especially advantageous when used with very thin stock material such as plastic sheet material having a thickness of about 0.001 inches. In this case the stock material is deformable and resilient and is usually made out of synthetic polymer such as polyethylene, polypropylene, nylon, and polyacrylonitrile.

The cutting means includes a razor blade cutting edge which is a continuous blade having a continuous body portion with two sides and two edges, one edge of which is a substantially straight razor sharp edge. In a preferred embodiment of the invention the continuous body portion of the blade has a maximum thickness of not less than about 0.01 inches and not more than about 0.04 inches.

The cutting means also includes a punch pressing means having blade supporting members which are moveable relative to each other so that the razor blade cutting edge can be secured for cutting and removed for replacement. Preferably, the blade supporting means is a clamping means continuous on both sides of the razor blade cutting edge. In order to provide sufficient support for the razor blade cutting edge, the continuous clamping means clamps over from about 50% to about 60% of the width of the blade in the holding position while the razor edge is exposed.

In one embodiment the razor blade cutting edge can comprise at least two separate blades mounted to form the desired cutting shape, with straight configured blades having a maximum thickness of not less than about 0.036 inches and bendable blades for irregular configuration having a maximum thickness of about 0.015 inches. In a preferred embodiment of the invention, however, the razor blade cutting edge is a single continuous blade having a maximum thickness of not more than about 0.015 inches which is clamped in a desired configuration without any discontinuities in the razor edge. For purposes of the present invention razor edge is meant to be an edge comparable to the edge of a razor blade.

As indicated above, the cutting assembly also includes a slot which is a continuous gap formed in a cutting surface in the same configuration as the cutting shape of the razor blade cutting edge. The gap preferably has a width of from about 0.040 inches to about 0.060 inches and a depth of not less than about ⅛ inches, while the preferred embodiment has a gap of about 0.060 inches and a depth of 3/16 inches. The cutting surface can be a steel punch plate having a thickness of from about 1/8 inches to about 3/16 inches which is secured on a steel backup plate.

Also included in the present invention is a method for die cutting a stack of layered stock material, especially very thin stock material, which includes providing the stack with a supporting cutting surface having a relief slot formed in the surface in the shape of the desired cut and applying cutting pressure to the stack with a razor blade cutting edge in the shape or configuration of the desired cutting shape opposite the slot so that the stack of layered stock material is cut in the desired shape.

As a result of the present invention, high speed manufacturing of stock material, which includes die stamping, can be effected without the many difficulties normally encountered in such production, such as destruction of cutting surface material, urethane or otherwise, and elimination of the need for a rotating cutter wheel which changes the location of the cutting surface.

The present invention also eliminates the occurrence of fused layers of material, such as in the case of fused plastic sheet material, which, in turn, causes sticking and hindrance of separation of the layers of material after processing.

The present invention is especially effective in the production of polymer plastic grocery bags in which the handle is cut out of the solid sheet material. For example, after the tube of plastic such as linear low density polyethylene is cut and sealed to form the bottom and top of the bag, a stack of the bags is subjected to the combination assembly of the invention thereby effecting a clean, efficient handle cut without hang up or fusing together of the bags.

Further and other benefits are realized by use of the preferred embodiment in which a single razor blade is employed. Specifically the single razor blade has a longer life and blade replacement is simplified. Moreover, as a result of elimination of hang up points, generally occasioned where blades meet, at least a 1% savings in plastic sheet material is realized, which is significant in high volume production.

Another advantage realized by the present invention is the elimination for the need of substantially perfect parallel alignment of the blade with the cutting surface, since the cutting slot allows the razor blade cutting edge to pass completely through the stack of layered stock material rather than stopping the edge as the lowest point of the cutting edge reaches the cutting plate first.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
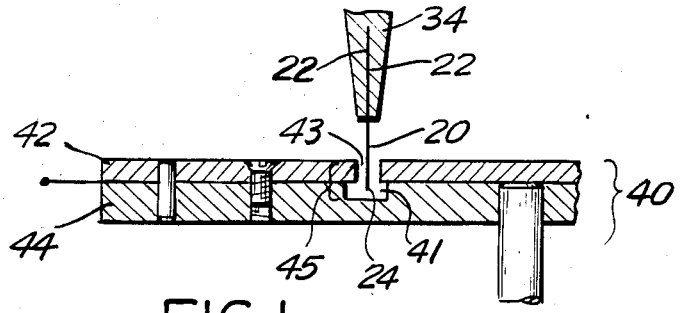
FIG. 1 is a elevational cross-section of the combination cutting surface and blade according to the present invention.
Figure 2:
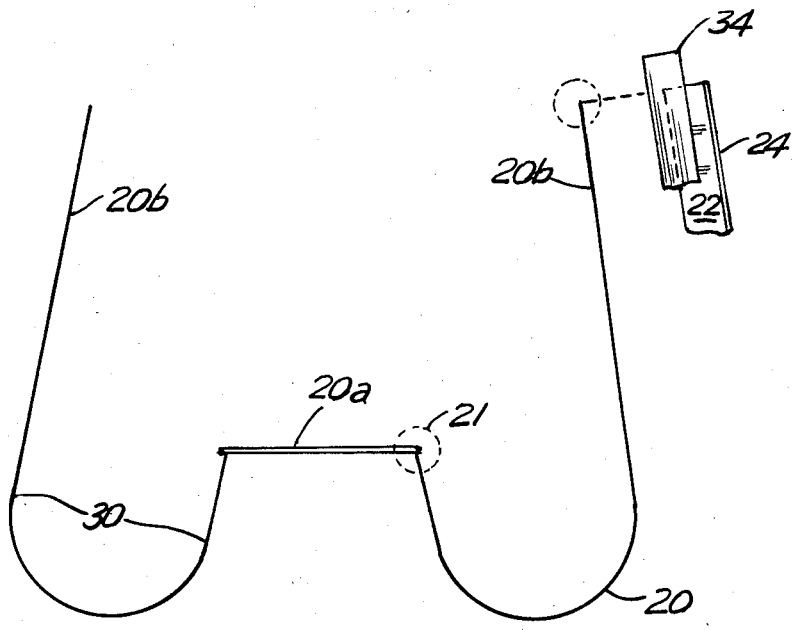
FIG. 2 is a schematic of one embodiment of the cutting blade in accordance with the present invention.
Figure 3:
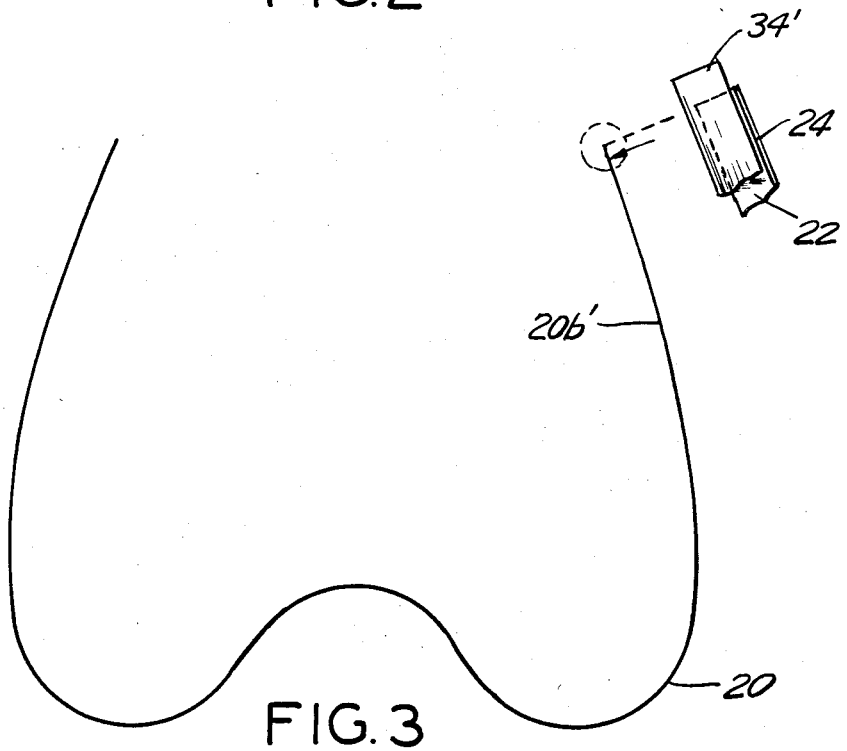
FIG. 3 is a schematic of a preferred embodiment of the cutting blade in accordance with the present invention.

Referring to the drawings, there can be seen an improved combination die cutting assembly according to the present invention which includes a razor blade cutting edge 20 mounted on any conventional punch pressing means (not shown herein) in the desired configuration of the die cut. In FIGS. 2 and 3 herein, the configuration is one used to cut handles in a layered stack of plastic bags such as those distributed for carrying supermarket items and the like. While the layered stack of stock material can be any conventional stock material such as paperboard, fiberboard, cardboard, etc. (the present invention having been found to be especially effective with very thin resilient deformable sheet material such as synthetic polymeric sheet material, e.g. polyethylene, polypropylene, nylon, and polyacrylonitrile), it is not meant to limit the present invention by the type of stock material used with the combination cutting assembly. It is contemplated that the present cutting means is clean and effective with stock material which is not more than about 0.001 inches thick per layer.

The razor blade cutting edge generally includes a continuous blade having a continuous body portion 22 with two sides and two edges, one edge of which is a substantially straight razor sharp edge 24. The continuous body portion can have a maximum thickness of not less than about 0.010 inches and not more than about 0.040 inches.

When more than one blade is used to prepare the desired cutting configuration such as shown in FIG. 2, straight blades such as **20*a* are usually about 0.036 inches wide, while irregularly configured blades, such as 20*b*, can conveniently be a thickness of about 0.015 inches whereby the body can easily be mounted in a curved or angular configuration as shown by curved segment 30**.

Referring in particular to the embodiment shown in FIG. 2 there can be seen a three blade configuration composed of two thin blades mounted in an irregular shape as well as a straight blade mounted between the two thin blades to provide a handle cut out for a plastic bag. The blades are mounted in a clamping means 34, which preferably covers from about 50% to about 60% of the mounted blade 22, and in the most preferred embodiment supports the blade body over about 60% of the blade portion. While this embodiment is quite effective in providing a high speed cutting means for manufacturing thin layered stock material, certain drawbacks are experienced due primarily to the need for three separate blades. In particular, blade replacement becomes more difficult because of the increased number of blades and the necessity for careful placement when mounting new blades.

For example, when the blades are not perfectly mounted, discontinuities such as that shown in circle 21 are created producing hang up points which hinder the removal and separation of the layers of stock material.

Many of these problems are overcome by one of the preferred embodiments shown in FIG. 3 in which there is but a single thin razor blade **20*b*' mounted to form the entire configuration on the punch press means. In this case, the clamping means 34' can support the thin blade 22 by covering over about 80% of the width of the blade. A similar support claim be utilized in the three blade system shown in FIG. 2**.

Directly opposite the mounted razor blade edge is located a punch plate 40 with a cutting slot 45 formed therein. The cutting slot 45 is in the same shape and size as the desired cutting shape formed by the razor blade cutting edge and when the punch plate pressing means is pressed towards the punch plate, the blade extends completely through the stack of layered stock material and into the gap 45.

The punch plate 40 can include an impact plate 42 mounted on a back up plate 44. In this way the slot 45 is formed by a gap 43 in the impact plate 42 in combination with a depression 41 in the backup plate 44.

Preferably the gap 43 has a width of from about 0.040 to about 0.080 while the depression 41 can have a width of from about $\frac{1}{8}$ to about $\frac{1}{4}$ and a depth of from about $\frac{1}{8}$ to about ¼. In one preferred embodiment of the invention wherein the impact plate 42 as well as the backup plate 44 is made of steel, the gap 43 has an overall gap of about 0.094 inches so that when a thick blade having a width of 0.036 inches is used, there is approximately 0.030 inches on either side of the blade. In the case of a thin blade having a thickness of 0.015 inches, the gap would be approximately 0.060 to about 0.080 inches so that the blade to steel plate distance will be approximately 0.022 inches on either side of the blade.

In one embodiment of the invention, the impact plate has a thickness of about ⅛ inch while the backup plate 44 has a thickness of about ¼ inch.

In operation, the cutting edge is moved toward the stock material. A stack of stock material can be about ⅝ inches high which usually includes from about 500 to about 600 layers of thin polymeric sheet material.

Thus, while there have been described what are presently believed to be the preferred embodiments of the invention, those skilled in the art will realize that changes and modifications may be made thereto without departing from the spirit of the invention and it is intended to claim all such changes and modifications as fall within the true scope of the invention.

I claim:

1. In the art of cutting dies for layers of stock material the improved combination assembly cutting means comprising:

razor blade cutter mounted in the desired cutting shape on a punch pressing means, said roazor blade cutter having a a continuous razor blade with a continuous body portion having maximum thickness of not less than about 0.010 inches and not more than about 0.040 inches, said blade having two sides and two edges, one of said edges being a substantially straight razor sharp continuous cutting edge, said razor blade comprised of at least two separate blades mounted to form the desired cutting shape, with straight configured blades having a maximum thickness of not less than about 0.036 inches, and irregularly configured blades having a maximum thickness of not more than about 0.015 inches; and a cutting slot formed in a cutting surface fixed opposite said cutting edge along the entire length thereof, whereby said razor blade cutting edge cuts completely through said layered stock material when said punch pressing means is pressed toward said punch plate.

2. The cutting means of claim 1 wherein said stock material is not more than about 0.001 inches thick per layer.

3. The cutting means of claim 2 wherein said stock material is a deformable material.

4. The cutting means of claim 3 wherein said material is a synthetic polymeric sheet material selected from the group consisting of polyethylene, polypropylene, nylon, and polyacrylonitrile.

5. The cutting means of claim 1 wherein said cutting surface comprises a steel impact plate secured on a steel backup plate.

6. The cutting means of claim 5 wherein said steel impact plate has a thickness of from about ⅛ inches to about 3/16 inches.

7. The cutting means of claim 1 wherein said punch pressing means comprises blade supporting members which are moveable relative to each other whereby said razor blade cutting edge is secured for cutting and removed for replacement.

8. The cutting means of claim 7 wherein said blade supporting means comprises clamping means.

9. The cutting means of claim 8 wherein said clamping mean is continuous on both sides of said razor blade cutting edge.

10. The cutting means of claim 9 wherein said continuous clamping means clamps over from about 40% to about 60% of the width of said blade with said razor edge exposed.

11. The cutting means of claim 1 wherein said razor blade cutting edge is a single continuous blade having a maximum thickness of not more than about 0.015 inches which is clamped in the desired configuration with no discontinuities in said razor edge.

12. The cutting means of claim 1 wherein said slot is continuous gap formed in said cutting surface in the same configuration as the cutting shape of said razor blade cutting edge, said gap having a width of from about 0.040 inches to about 0.080 inches and a depth of not less than about ⅛ inches.

13. The cutting means of claim 12 wherein said gap is about 0.060 inches wide and about 3/16 inches in depth.

14. A method for die cutting a stack of layered material comprising;

providing said stack with a supporting surface having a relief slot formed in said surface in the shape of the desired cut; and applying cutting pressure to said stack with a razor blade cutter in the configuration of the desired cutting shape opposite said slot, said razor blade cutter having a maximum thickness of not less than about 0.01 inches and not more than about 0.040 inches, said blade having a continuous blade with a continuous body portion having two sides and two edges, one of said edges being a substantially straight razor sharp continuous cutting edge, said razor blade comprised of at least two separate blades mounted to form the desired cutting shape, with straight configured blades having a maximum thickness of not less than about 0.030 inches, and irregularly configured blades having a maximum thickness of not more than about 0.015 inches, whereby said stack of layered stock material is cut in the desired shape.

15. The method of claim 14 wherein said stock material is not more than about 0.001 inches thick per layer.

16. The method of claim 15 wherein said stock material is a deformable material.

17. The method of claim 16 wherein said material is a synthetic polymeric sheet material selected from the group consisting of polyethylene, polypropylene, nylon, and polyacrylonitrile.

* * * * *